US006551097B1

(12) United States Patent
Huang

(10) Patent No.: US 6,551,097 B1
(45) Date of Patent: Apr. 22, 2003

(54) PRESS TYPE LIGHTER HAVING A SAFETY SWITCH

(76) Inventor: Ying Fang Huang, No. 2, Lane 22, Sec. 2, Shanshi Rd., Bei Chiu, Taichung (TW)

( * ) Notice: Subject to any disclaimer, the term of this patent is extended or adjusted under 35 U.S.C. 154(b) by 0 days.

(21) Appl. No.: 10/139,258

(22) Filed: May 7, 2002

(51) Int. Cl.[7] ..... F23Q 2/28

(52) U.S. Cl. ..... 431/153; 153/431; 153/132; 153/255; 153/129

(58) Field of Search ..... 431/153, 255, 431/253, 277, 129, 132

(56) References Cited

U.S. PATENT DOCUMENTS 5,662,466 A * 9/1997 Cheng ..... 431/255
6,039,561 A * 3/2000 Lei ..... 431/153
6,135,761 A * 10/2000 Chen ..... 431/132
6,186,772 B1 * 2/2001 Huang ..... 431/153
6,431,853 B1 * 8/2002 Sher ..... 431/129

* cited by examiner

*Primary Examiner*—James C. Yeung
(74) *Attorney, Agent, or Firm*—Rosenberg, Klein & Lee

(57) ABSTRACT

A press type lighter having a safety switch includes a clutch structure for controlling the press member and the flow of fuel gas from the liquid gas container to be disposed at a locking or free state. A control member is movably mounted in the receiving chamber of the press member, and has a bottom provided with a leg portion which has a bottom formed with a locking flange rested on a top edge of the liquid gas container. The press member is formed with a locking hole for locking the locking flange of the control member, thereby forming a first-stage safety switch structure by the locking flange and the locking hole, for locking the press member temporarily, so that the press member is locked on the liquid gas container.

7 Claims, 10 Drawing Sheets

PRESS TYPE LIGHTER HAVING A SAFETY SWITCH

BACKGROUND OF THE INVENTION

1. Field of the Invention

The present invention relates to a press type lighter having a safety switch, and more particularly to a press type lighter having a safety switch, wherein the lighter cannot be operated easily and unintentionally, thereby providing a double safety effect.

2. Description of the Related Art

A conventional press type lighter in accordance with the prior art is disclosed in the applicant's U.S. Pat. No. 6,231,335B1. However, the conventional press type lighter disclosed in the applicant's U.S. Pat. No. 6,231,335B1 has a complicated construction with many parts, thereby increasing costs of fabrication.

SUMMARY OF THE INVENTION

The primary objective of the present invention is to provide a press type lighter having a safety switch, wherein the slide knob has to proceed a substantially L-shaped movement to trigger the igniter and light the lighter, so that the lighter cannot be operated easily and unintentionally, thereby providing a double safety effect.

Another objective of the present invention is to provide a press type lighter having a safety switch having a simple construction, thereby saving cost of fabrication.

In accordance with the present invention, there is provided a press type lighter having a safety switch, comprising a liquid gas container, a press member pivotally mounted on the liquid gas container for controlling the flow of gas from the liquid gas container, and a clutch structure mounted in the press member, for controlling which of a locking state and a free state the press member is disposed.

The clutch structure includes a receiving chamber formed in the press member, a control member is mounted in the receiving chamber, and has a bottom provided with a leg portion, the leg portion of the control member has a bottom formed with a locking flange rested on a top edge of the liquid gas container, the press member has one side having a bottom formed with a locking hole to lock the locking flange of the control member, thereby forming a first-stage safety switch structure by the locking flange and the locking hole, so that the press member is locked on the liquid gas container.

Further benefits and advantages of the present invention will become apparent after a careful reading of the detailed description with appropriate reference to the accompanying drawings.

DETAILED DESCRIPTION OF THE INVENTION

Figure 1:
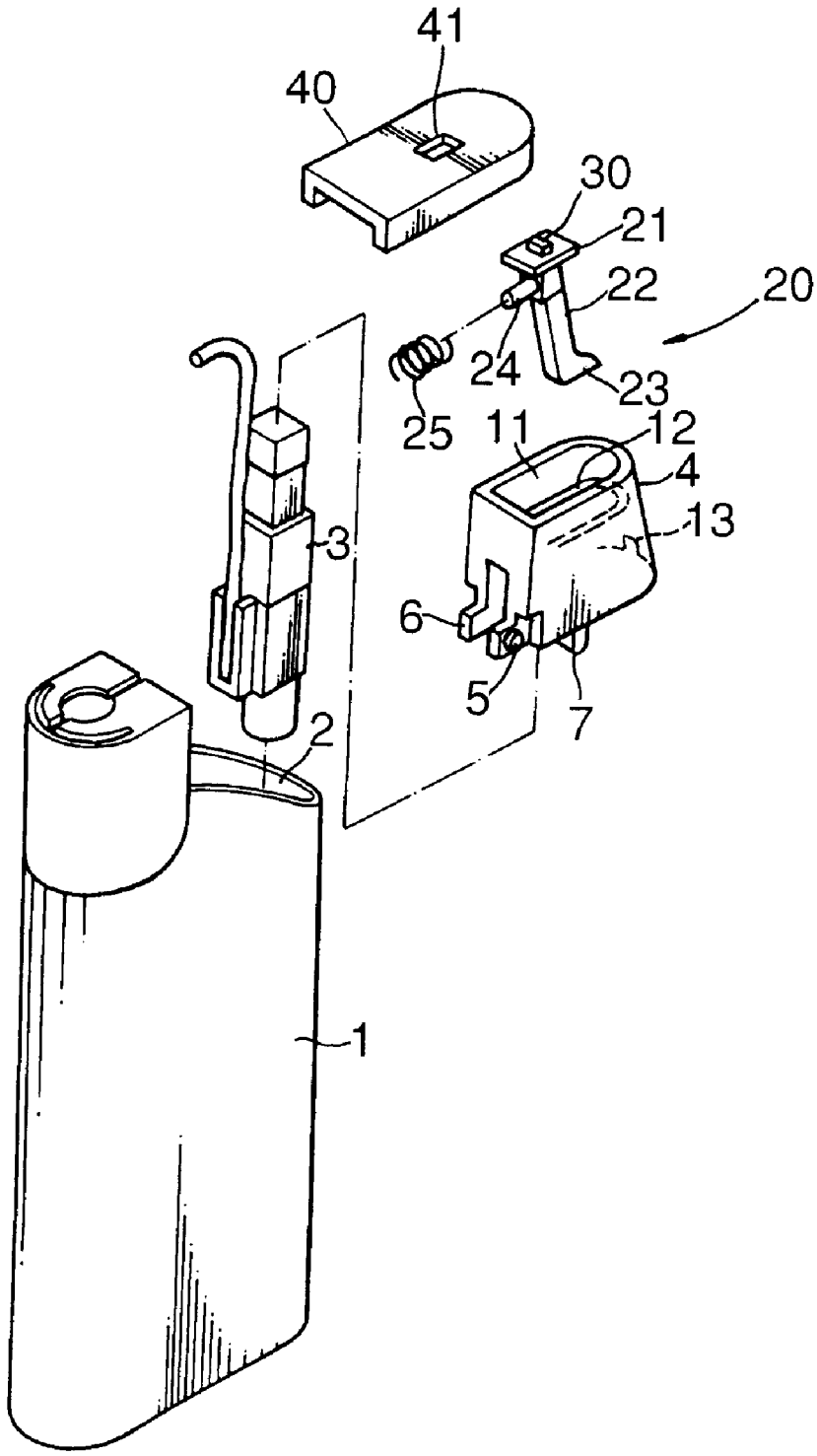
FIG. 1 is an exploded perspective view of a press type lighter having a safety switch in accordance with a first embodiment of the present invention.
Figure 2:
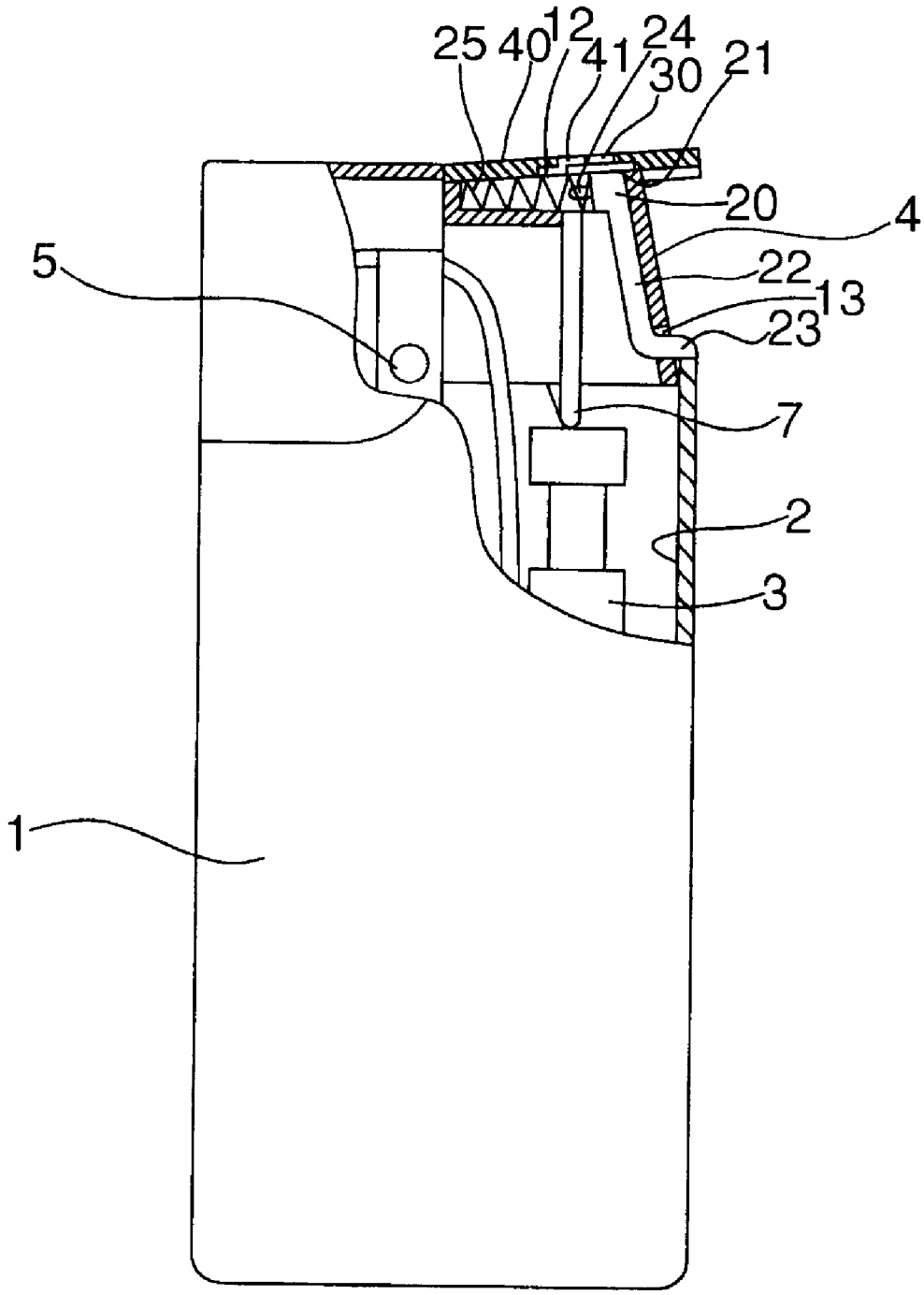
FIG. 2 is a side plan partially cross-sectional assembly view of the press type lighter having a safety switch as shown in FIG. 1
Figure 3:
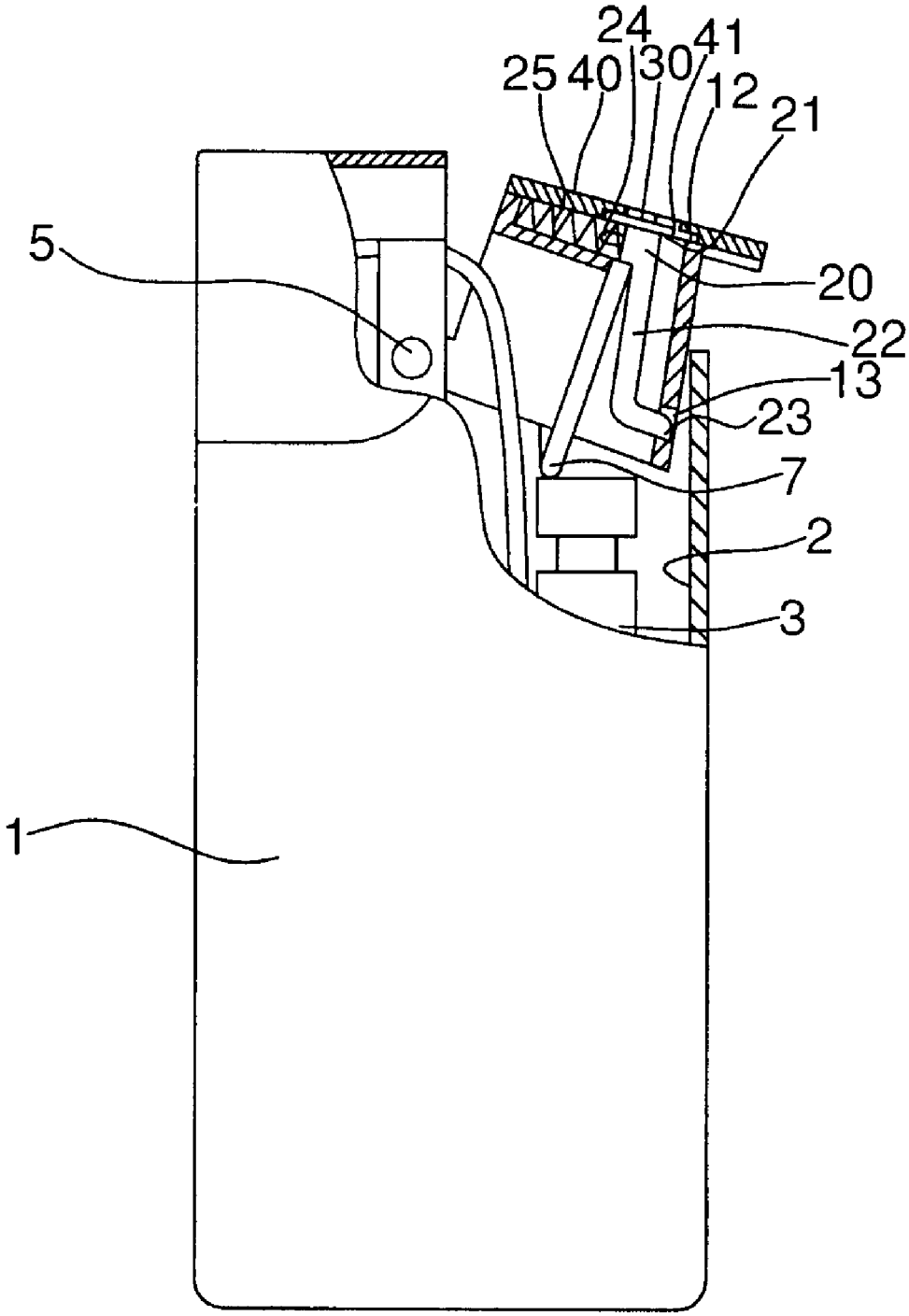
FIG. 3 is a schematic operational view of the press type lighter having a safety switch as shown in FIG. 2 in use.
Figure 4:
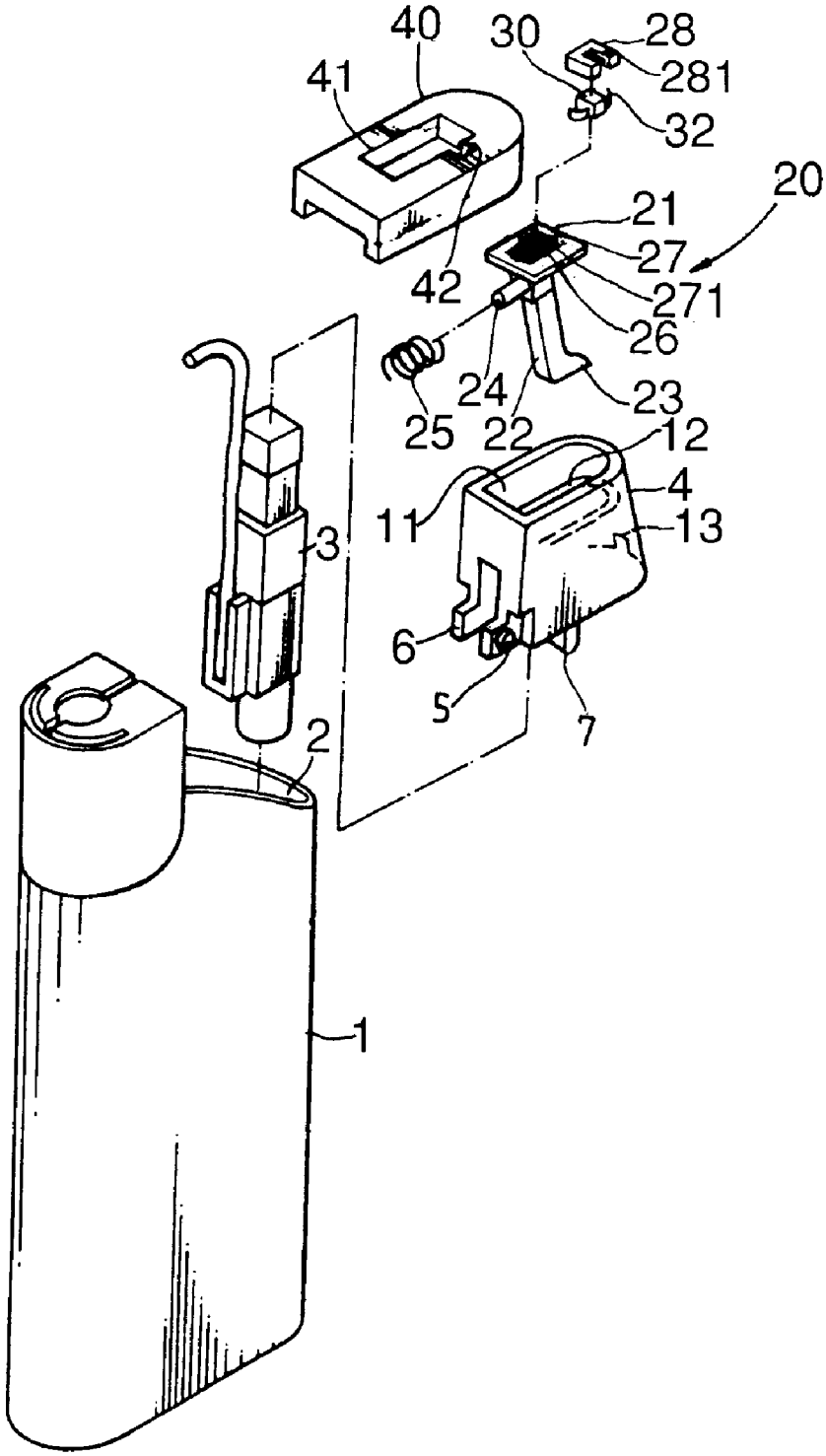
FIG. 4 is an exploded perspective view of a press type lighter having a safety switch in accordance with a second embodiment of the present invention.
Figure 5:
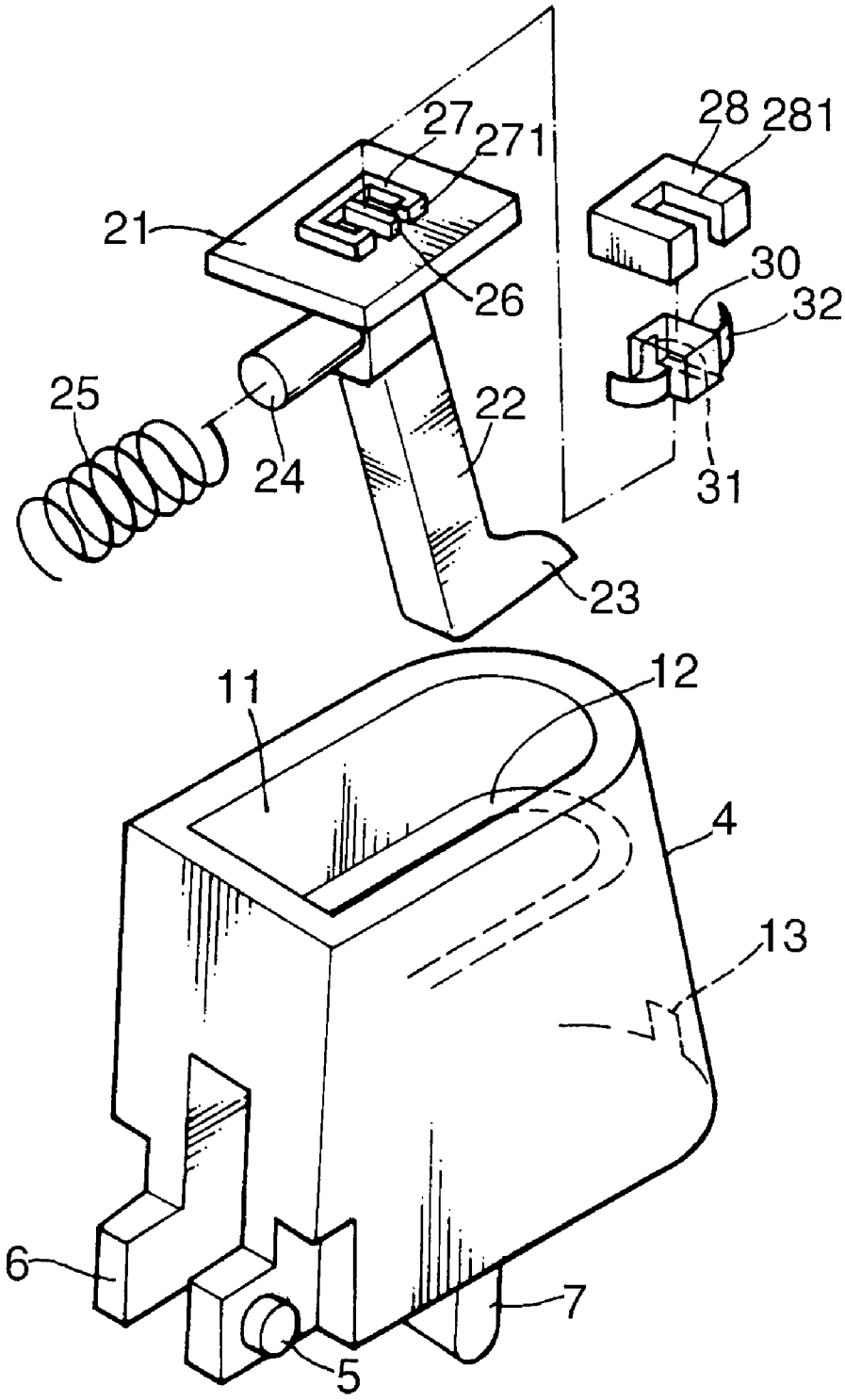
FIG. 5 is a partially exploded perspective. view of the press type lighter having a safety switch in accordance with the second embodiment of the present invention.
Figure 6:
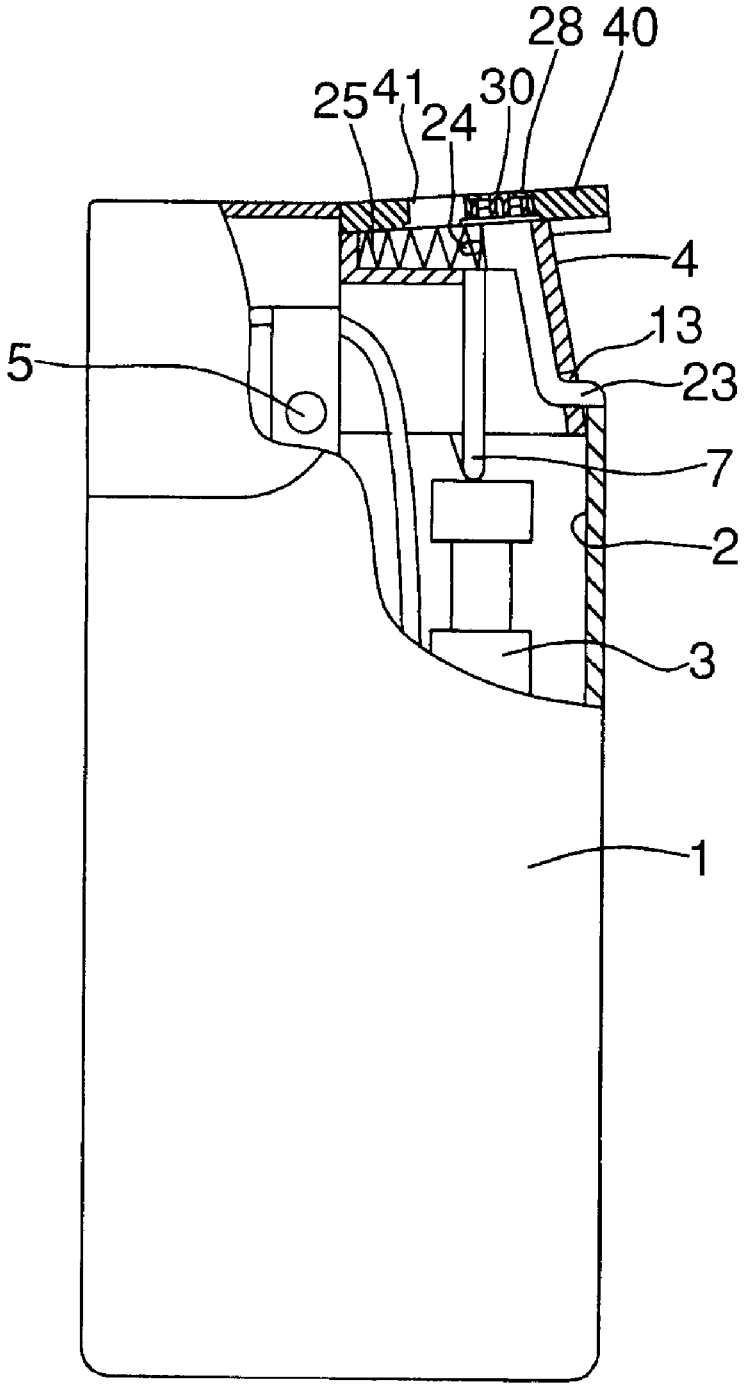
FIG. 6 is a side plan partially cross-sectional assembly view of the press type lighter having a safety switch as shown in FIG. 4.

Referring to the drawings and initially to FIGS. 1–3, a press type lighter having a safety switch in accordance with a first embodiment of the present invention comprises a liquid gas container 1 having an inside formed with a receiving space 2, an igniter 3 mounted in the receiving space 2, and a press member 4 pivotally mounted in the receiving space 2. The press member 4 has a first side having a bottom provided with a pivot shaft 5 pivotally mounted in the receiving space 2. The pivot shaft 5 is provided with a forked bar 6 which is connected to a gas open/close valve (not shown). The press member 4 has a bottom provided with a trigger 7 which is rested on the igniter 3.

Thus, when the user exerts a downward pressure on the press member 4, the press member 4 may be pivoted about the pivot shaft 5, so that the forked bar 6 may operate the gas open/close valve and the trigger 7 may trigger the igniter 3, so that the lighter may be lighted conveniently.

A clutch structure is mounted in the press member 4, for controlling the press member 4 and the flow of fuel gas from the liquid gas container 1 to be disposed at a first-stage locking or free state.

The clutch structure includes a receiving chamber 11 formed in the press member 4. The receiving chamber 11 has an inner wall provided with a guide rail 12.

A control member 20 is movably mounted in the receiving chamber 11, and includes a guide plate 21 mounted on the guide rail 12 to be slidable therewith. The control member 20 includes a leg portion 22 mounted on the bottom of the guide plate 21. The leg portion 22 of the control member 20 has a bottom formed with a locking flange 23 rested on a top edge of the receiving space 2 of the liquid gas chamber 1.

The press member 4 has a second side having a bottom formed with a locking hole 13 for receiving the locking flange 23 of the control member 20. Thus, the locking flange 23 of the control member 20 is passed through the locking hole 13 of the press member 4, and is rested on the top edge of the receiving space 2 of the liquid gas container 1, so as to position the press member 4, so that the press member 4 cannot be pressed downward, thereby preventing the press member 4 from being pivoted about the pivot shaft 5 to trigger the igniter 3 and light the lighter, so that the liquid gas container 1 is disposed at an actually locking state.

The leg portion 22 of the control member 20 is provided with a guide rod 24 for mounting an elastic member 25 which is biased between the inner wall of the press member 4 and the leg portion 22 of the control member 20, for pressing the locking flange 23 of the control member 20 to pass through the locking hole 13 of the press member 4, and to rest on the top edge of the receiving space 2 of the liquid gas container 1.

A slide knob 30 is mounted on the top of the guide plate 21 of the control member 20. A top cover 40 is secured on the top of the press member 4, and is formed with a guide slot 41, so that the slide knob 30 may slide in the guide slot 41 of the top cover 40.

In operation, the locking flange 23 of the control member 20 is initially passed through the locking hole 13 of the press member 4, and is rested on the top edge of the receiving space 2 of the liquid gas container 1 as shown in FIG. 2, so that the liquid gas container 1 is disposed at an actually locking state.

Then, the slide knob 30 may be pushed to overcome the elastic force of the elastic member 25 to slide in the guide slot 41 of the top cover 40 so as to move from the position as shown in FIG. 2 to the position as shown in FIG. 3, thereby detaching the locking flange 23 of the control member 20 from the top edge of the receiving space 2 of the liquid gas container 1, so that when the press member 4 is pressed downward, the press member 4 is pivoted about the pivot shaft 5 to move the trigger 7 to trigger the igniter 3 and to light the lighter, so that the liquid gas container 1 is disposed at an unlocking state.

Accordingly, the locking flange 23 of the control member 20 and the locking hole 13 of the press member 4 may form the first-stage safety switch structure.

Referring to FIGS. 4–8, a press type lighter having a safety switch in accordance with a second embodiment of the present invention further comprises a second-stage safety switch structure mounted between the slide knob 30, the control member 20 and the top cover 40.

The second-stage safety switch structure includes a locking recess 42 formed in the guide slot 41 of the top cover 40, so that the locking recess 42 and the guide slot 41 of the top cover 40 may form a substantially L-shaped structure. The control member 20 includes a locking rail 26 mounted on the top of the guide plate 21. The slide knob 30 may slide in the locking recess 42, and has a bottom formed with a channel 31 for receiving the locking rail 26 of the control member 20, so that the slide knob 30 may slide in the locking recess 42 by guidance of the locking rail 26 of the control member 20 to move into the guide slot 41 of the top cover 40.

The control member 20 includes a substantially inverted U-shaped positioning block 27 mounted on the top of the guide plate 21 and enclosed around the locking rail 26, for enhancing the stability of movement of the slide knob 30. The positioning block 27 has two distal ends each formed with a hook portion 271 located beside the locking rail 26. The control member 20 includes an inner cover 28 mounted on the positioning block 27 for covering the slide knob 30. The inner cover 28 is formed with a secondary channel 281. The slide knob 30 is protruded outward from the secondary channel 281 of the inner cover 28 into the locking recess 42.

The slide knob 30 has two sides each provided with a wing-shaped elastic member 32 which is rested on the positioning block 27, so that the slide knob 30 is pushed by the two wing-shaped elastic members 32 to move toward a direction away from the guide slot 41 of the top cover 40, thereby forming the second-stage safety switch structure.

Figure 7:
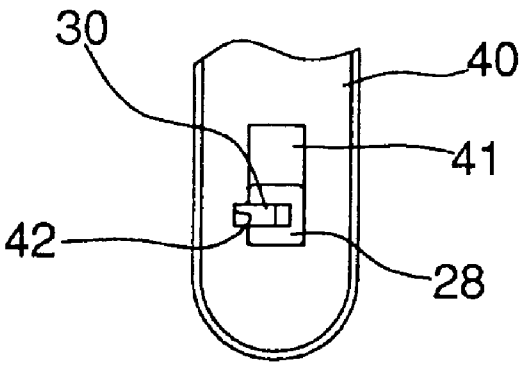
FIG. 7 is a top plan partially cut-away assembly view of the press type lighter having a safety switch as shown in FIG. 4.

In operation, the slide knob 30 is initially locked in the locking recess 42 as shown in FIG. 7. Then, the slide knob 30 may be pushed to overcome the elastic force of the two wing-shaped elastic members 32 to slide in the locking recess 42 from the position as shown in FIG. 7 to the position as shown in FIG. 9 where the slide knob 30 is detached from the locking recess 42, so that the slide knob 30 may slide in the guide slot 41 of the top cover 40 freely.

Figure 8:
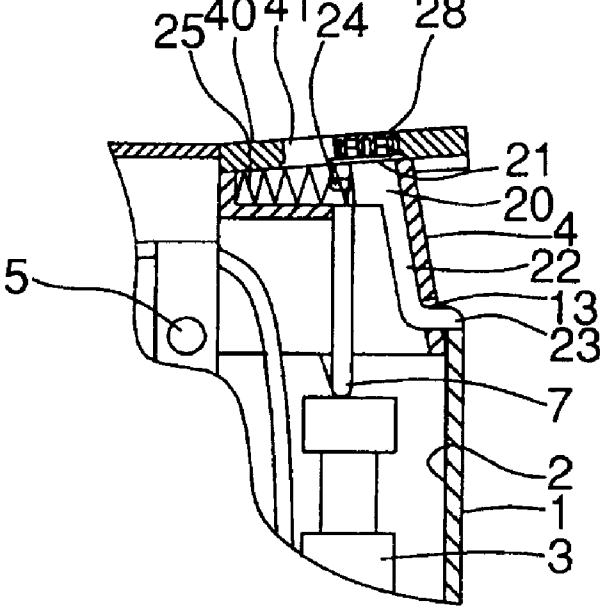
FIG. 8 is a partially enlarged view of the press type lighter having a safety switch as shown in FIG. 6.

At the same time, the locking flange 23 of the control member 20 is initially passed through the locking hole 13 of the press member 4, and is rested on the top edge of the receiving space 2 of the liquid gas container 1 as shown in FIG. 8, so that the liquid gas container 1 is disposed at an actually locking state.

Figure 9:
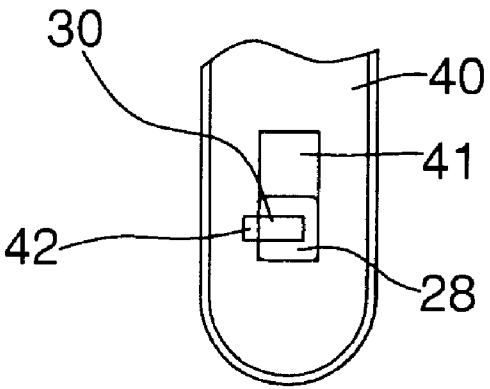
FIG. 9 is a schematic operational view of the press type lighter having a safety switch as shown in FIG. 7 in use.
Figure 11:
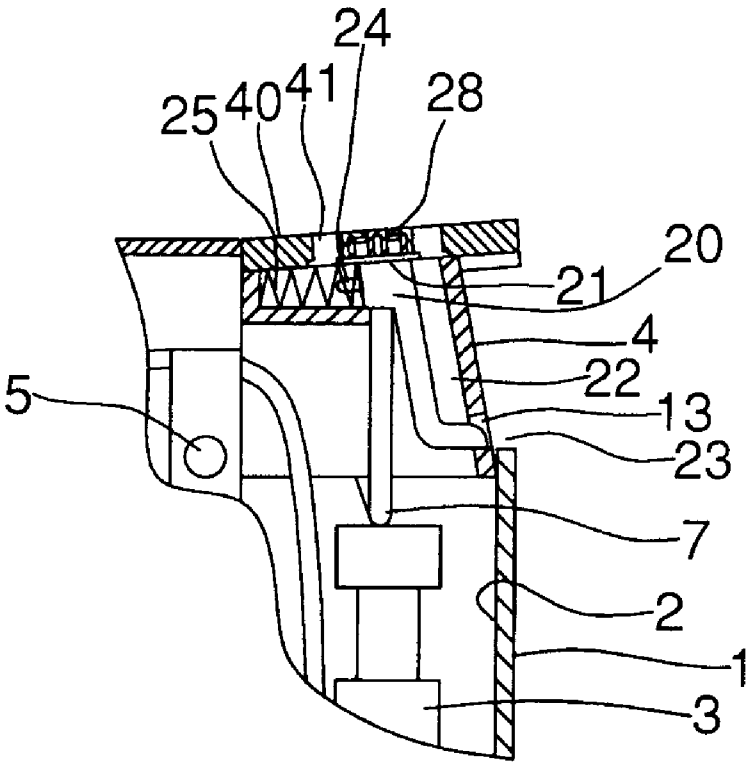
FIG. 11 is a schematic operational view of the press type lighter having a safety switch as shown in FIG. 8 in use.
Figure 10:
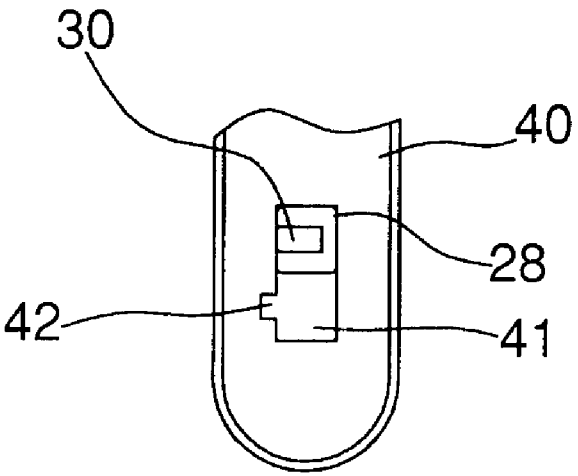
FIG. 10 is a schematic operational view of the press type lighter having a safety switch as shown in FIG. 9 in use.
Figure 12:
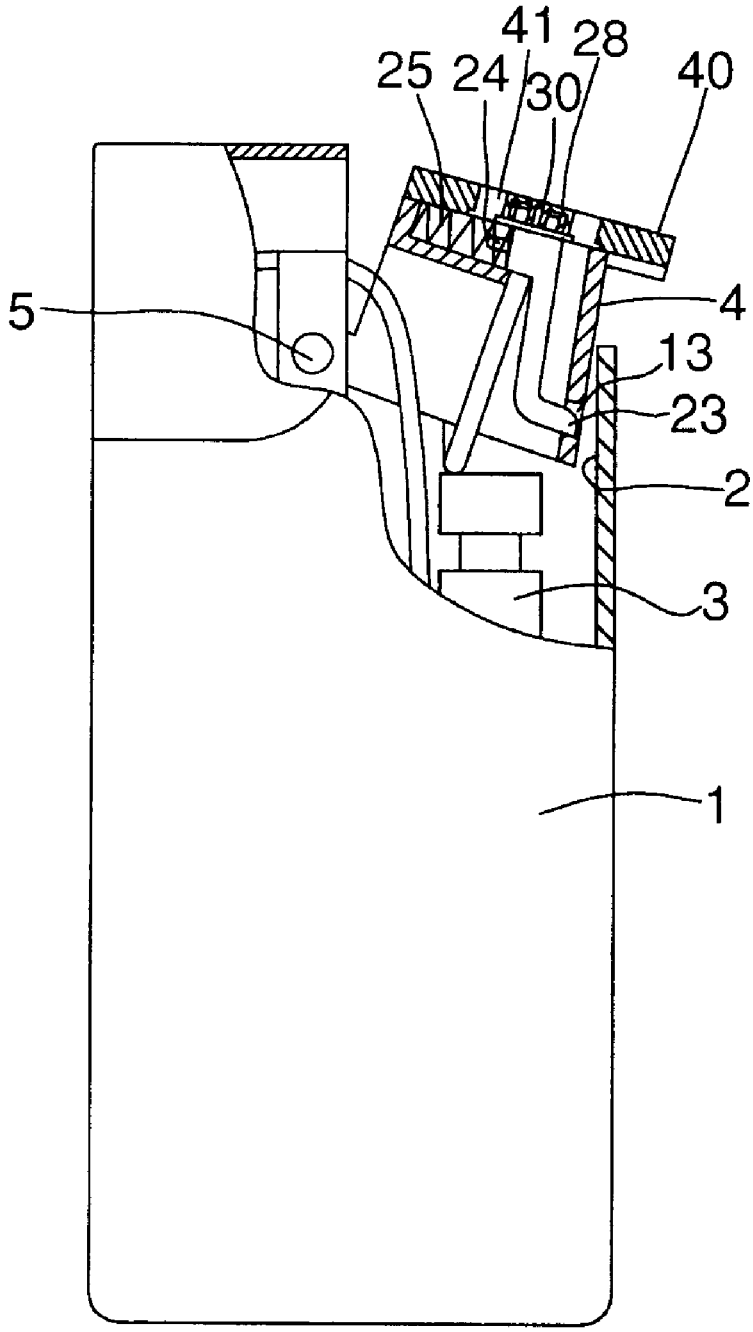
FIG. 12 is a schematic operational view of the press type lighter having a safety switch as shown in FIG. 11 in use.

Then, the slide knob 30 may be pushed to overcome the elastic force of the elastic member 25 to slide in the guide slot 41 of the top cover 40 so as to move from the position as shown in FIGS. 8 and 9 to the position as shown in FIGS. 10 and 11, thereby detaching the locking flange 23 of the control member 20 from the top edge of the receiving space 2 of the liquid gas container 1, so that the press member 4 may be pressed downward as shown in FIG. 12, and may be pivoted about the pivot shaft 5 to trigger the igniter 3 and to light the lighter, so that the liquid gas container 1 is disposed at an unlocking state.

Accordingly, the second-stage safety switch structure is mounted between the slide knob 30, the control member 20 and the top cover 40, whereby the slide knob 30 has to proceed a substantially L-shaped movement to trigger the igniter 3 and light the lighter, so that the lighter cannot be operated easily and unintentionally, thereby providing a double safety effect. In addition, the press type lighter having a safety switch in accordance with the present invention has a simple construction, thereby saving cost of fabrication.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A press type lighter having a safety switch, comprising:

a liquid gas container;

a press member pivotally mounted on the liquid gas container for controlling a flow of fuel gas from the liquid gas container;

a clutch structure mounted in the press member for controlling which of a locking state and a free state the press member is disposed, the clutch structure including (a) a receiving chamber formed in the press member and having a guide rail formed on an inner wall thereof, (b) a control member movably mounted in the receiving chamber, the control member having a guide plate at an upper end thereof, the guide plate being slidably disposed on the guide rail, the control member having a leg portion extending from a lower side of the guide plate, the leg portion of the control member having a locking flange formed on a bottom end thereof, and (c) a locking hole formed through a lower portion of a wall of the press member for passage therethrough of the locking flange of the control member to rest on a top edge of the liquid gas container, thereby forming a first-stage safety switch structure by the locking flange and the locking hole, so that the press member is locked against pivoting on the liquid gas container;

a slide knob disposed on an upper side of the guide plate;

a top cover secured on a top of the press member and having a guide slot formed therein, the slide knob being displaceable within the guide slot to displace the locking flange therewith; and, a second stage safety switch structure including a locking recess formed in the top cover in open communication with the guide slot, the locking recess and the guide slot together having an L-shaped contour.

2. The press type lighter having a safety switch in accordance with claim 1, wherein the control member includes an elastic member mounted between an inner wall of the press member and the leg portion of the control member to bias the locking flange of the control member to pass through the locking hole of the press member and to rest on the top edge of the liquid gas container, so that the press member is locked against pivoting on the liquid gas container.

3. The press type lighter having a safety switch in accordance with claim 2, wherein the leg portion of the control member has a guide rod extending therefrom, the guide rod receiving one end of the elastic member thereon.

4. The press type lighter having a safety switch in accordance with claim 1, wherein the guide plate is provided with a locking rail, the slide knob being slidably mounted in the locking recess, a bottom of the slide knob being formed with a channel to receive the locking rail of the control member therein, so that the slide knob is slidable in the locking recess by guidance of the locking rail of the control member to move into the guide slot of the top cover.

5. The press type lighter having a safety switch in accordance with claim 4, wherein the guide plate is provided with a substantially inverted U-shaped positioning block enclosed around the locking rail and having two distal ends each formed with a hook portion located beside the locking rail, and an inner cover mounted on the positioning block to cover the slide knob.

6. The press type lighter having a safety switch in accordance with claim 5, wherein the inner cover is formed with a secondary channel, and the slide knob is protruded outward from the secondary channel of the inner cover into the locking recess.

7. The press type lighter having a safety switch in accordance with claim 5, wherein the slide knob has two sides each provided with a wing-shaped elastic member which is rested on the positioning block, so that the slide knob is pushed by the wing-shaped elastic member to move toward a direction away from the guide slot of the top cover.

* * * * *